US011833848B2

(12) United States Patent
Barberan Latorre

(10) Patent No.: US 11,833,848 B2
(45) Date of Patent: Dec. 5, 2023

(54) METHOD AND SYSTEM FOR PRODUCING RELIEFS ON SUBSTRATES

(71) Applicant: Jesus Francisco Barberan Latorre, Castelldefels (ES)

(72) Inventor: Jesus Francisco Barberan Latorre, Castelldefels (ES)

( * ) Notice: Subject to any disclaimer, the term of this patent is extended or adjusted under 35 U.S.C. 154(b) by 0 days.

(21) Appl. No.: 17/692,851

(22) Filed: Mar. 11, 2022

(65) Prior Publication Data

US 2022/0305829 A1 Sep. 29, 2022

(30) Foreign Application Priority Data

Mar. 26, 2021 (EP) ..... 21382250

(51) Int. Cl.

| | |
|---|---|
| ***B41J 3/407*** | (2006.01) |
| ***B41M 1/38*** | (2006.01) |
| ***B41F 16/00*** | (2006.01) |
| ***B41J 2/005*** | (2006.01) |
| ***B41M 1/40*** | (2006.01) |

(52) U.S. Cl.

CPC ..... *B41M 1/38* (2013.01); *B41F 16/0033* (2013.01); *B41J 2/0057* (2013.01); *B41M 1/40* (2013.01); *B41J 3/407* (2013.01)

(58) Field of Classification Search

CPC . B41M 1/38; B41M 1/40; B41J 2/0057; B41J 3/407; B41F 16/0033

See application file for complete search history.

(56) References Cited

U.S. PATENT DOCUMENTS

| | | | | |
|---|---|---|---|---|
| 2015/0030817 | A1 | 1/2015 | Wiegelmann et al. | |
| 2021/0129577 | A1* | 5/2021 | Saito | B32B 25/08 |
| 2021/0245544 | A1* | 8/2021 | Barberan Latorre | B41F 16/0033 |

FOREIGN PATENT DOCUMENTS

| | | | | |
|---|---|---|---|---|
| DE | 19642036 | A1 * | 4/1998 | G09F 27/00 |
| EP | 2108524 | A1 | 10/2009 | |
| EP | 2507063 | B1 | 9/2014 | |
| WO | 2011064075 | A2 | 6/2011 | |
| WO | 2018122732 | A1 | 7/2018 | |
| WO | 2020115337 | A1 | 6/2020 | |
| WO | WO-2021052627 | A1 * | 3/2021 | B28B 11/001 |

OTHER PUBLICATIONS

Waldner, MachineTranslationofWO-2021052627-A1, 2021 (Year: 2021).*

Contzen, MachineTranslationofDE-19642036-A1, 1998 (Year: 1998).*

European Search Report for corresponding Application No. EP 21382250 dated Sep. 8, 2021.

* cited by examiner

*Primary Examiner* — Scott A Richmond

(74) *Attorney, Agent, or Firm* — LUCAS & MERCANTI, LLP

(57) ABSTRACT

A method and system for producing reliefs on substrates by digital inkjet printing of drops of a relief material which is deposited on localized areas of the surface of a substrate to obtain a relief surface with a relief determined by the relief material deposited, a coating sheet being incorporated over the relief material deposited, which conforms to said relief surface, the coating sheet being fixed by gluing by means of a glue which is applied together or in combination with the relief material.

14 Claims, 14 Drawing Sheets

METHOD AND SYSTEM FOR PRODUCING RELIEFS ON SUBSTRATES

CROSS-REFERENCE TO RELATED APPLICATION

This application claims priority of European Patent Application No. 21382250.5, filed Mar. 26, 2021, the contents of which is incorporated herein by reference.

TECHNICAL FIELD

The present invention is related to the production of reliefs on substrates, in particular by means of digital inkjet printing, to obtain surfaces with tactile and visual textures, in applications such as the manufacturing of products for construction or furniture, such as panels for furniture, doors and floors, profiles for frames, etc.

STATE OF THE ART

Different methods for producing reliefs on substrates are currently known, noteworthy among which are those based on digital inkjet printing, which allow reliefs with a high degree of flexibility and definition to be obtained compared to other methods for obtaining reliefs on substrates, such as engraving or molding.

In known methods for producing reliefs on substrates by means of digital inkjet printing, drops of a relief material are deposited on localized areas of the surface of the substrate, determining the relief to be obtained. Depending on the relief material used, positive relief surfaces can be created, which comprise projections formed by relief material that is applied to localized areas, or negative relief surfaces, which comprise recesses determined by the relief material that settles, is displaced or is introduced in said areas, in particular due to the impact of the drops of the relief material on a previously applied substrate layer in a liquid or pasty state.

In these cases, the positive relief surfaces that are obtained have the drawback of limited resistance to the abrasion of the relief, while the negative relief surfaces have a drawback in that the parameters of the method for producing reliefs that influence the definition of the reliefs, such as surface tension, density, viscosity, etc. of the product applied and the base layer, are difficult to control.

In light of the drawbacks of known solutions, there is a clear interest in providing a method and system for producing reliefs on substrates that allow reliefs to be obtained with flexibility in suitable conditions of definition and resistance to the abrasion of reliefs.

OBJECT OF THE INVENTION

According to the present invention, a method for producing reliefs on a substrate is proposed which comprises the application or provision by digital inkjet printing of a relief material that is deposited in localized areas of the surface of a substrate to obtain a relief surface with a relief determined by the relief material deposited. Over the relief material deposited a coating sheet is incorporated, which conforms to said relief surface. The coating sheet is fixed to the substrate by gluing by means of a glue that is applied together or in a combined way with the relief material.

According to the invention, the relief material and, optionally, the glue, is deposited in localized areas of the surface of the substrate, in particular able to be applied directly on the substrate and/or the coating sheet.

According to the invention, digital inkjet printing is preferably used to apply drops of a relief material, in particular to make a positive filling of the relief material between the substrate and a coating sheet, which deforms over said filler material, such that on the substrate of application a relief surface is obtained, in particular with a tactile relief texture that can also be visibly noticed.

The provision of the relief material by means of inkjet printing, to create relief, can be done interchangeably or in a combined way on the substrate of application and the coating sheet, together providing, in the inkjet printing, a glue for fixing the coating sheet, or combining the provision of relief material by inkjet printing with an inkjet application providing the necessary glue to fix the coating sheet or with other conventional methods of providing glue, such as by applicator rollers, applicator lips, spraying, etc.

Thus, in the context of the present invention, by applying the relief material and the glue together, it is understood that the relief material and the glue are provided by means of the same inkjet pass or application, in particular in the same inkjet drop or in separate drops. By combined application it is understood that the relief material and the glue are provided by means of different applications or inkjet passes or by different application means.

Thus, a very versatile and flexible method is obtained, by means of which highly precise reliefs are achieved, defined by inkjet printing and with resistance to abrasion, which does not have to be withstood by the relief material but rather by the coating sheet, with pre-established configurations of the relief surfaces able to be determined.

Preferably, the application of the relief material is synchronized with motifs that are arranged on the substrate and/or on the coating sheet. In the context of the present invention, a motif can be a decoration or a functional element, in particular an image or a relief. In particular, the motif can be arranged printed on the substrate and/or on the coating sheet, more particularly by means of inkjet printing.

The synchronization of the application of relief material allows reliefs to be obtained that spatially correspond with motifs on the substrate and/or the sheet with a predetermined shape. In particular, said spatial correspondence can consist of a relief and the corresponding motif being arranged in a coinciding position. This way, visual effects in combination with haptic effects are achieved, required in the final product, for example for finishes that imitate natural surfaces, such as stone or wood.

According to the invention, it is envisaged that the coating sheet can be at least partially transparent, especially in such a way that a corresponding motif can be seen through said sheet.

The motif corresponding to the relief can be carried out during the same inkjet pass or application as the relief material or the glue, in particular applying the ink or printing material of the motif and the relief material in the same inkjet drop or in separate drops. Likewise, it is envisaged that the application of the motif corresponding to the relief is carried out before and/or after the application of the relief material or of the glue. Likewise, said corresponding motif can be incorporated in the coating sheet and/or in the substrate.

To carry out the synchronization and, therefore, the correspondence between the relief and the motif by means of digital printing, a data file can be used as a starting point with a digital representation of the motif to be synchronized or the data file may also be obtained online, for example by means of a scan of said motif. The data file of the motif is processed to control the application positions and times of the printing material for the motif, the relief material or the glue, in particular considering the advance of the substrate since it is transported when the method is performed.

According to another aspect, the present invention provides a system for producing reliefs on substrates using a method according to the one previously described. The system comprises digital inkjet printing means to apply the relief material, the transport means of the substrate and the incorporation means for the coating sheet to incorporate the coating sheet over the substrate.

Preferably, the system can comprise guide means for the coating sheet, glue application means, scanning means configured to capture a motif arranged on the substrate or the coating sheet and/or control means to carry out said method.

According to the invention, the means for feeding the coating sheet can comprise guide rollers in a way that is known. Likewise, the transport means of the substrate are envisaged for continuous substrates or for independent substrates. Continuous substrates can be, for example, in the form of continuous sheets. Independent substrates can be, for example, in the form of sheets or panels. The transport means for continuous substrates can comprise guide rollers. The transport means for independent substrates can comprise a conveyor belt or a roller table.

Therefore, said method, as well as the system object of the invention, result in highly advantageous features for the production of textured relief surfaces on substrates for which it is intended, acquiring a life of its own and preferential features with respect to the methods and systems that are currently known for said function.

DETAILED DESCRIPTION OF THE INVENTION

The object of the invention relates to a method for producing a relief or textured surface on a substrate (1) that is covered with a decorative coating sheet (2), incorporating a relief material (3) that is included between the substrate (1) and the coating sheet (2) in correspondence or not with printed images (15).

Figure 1:
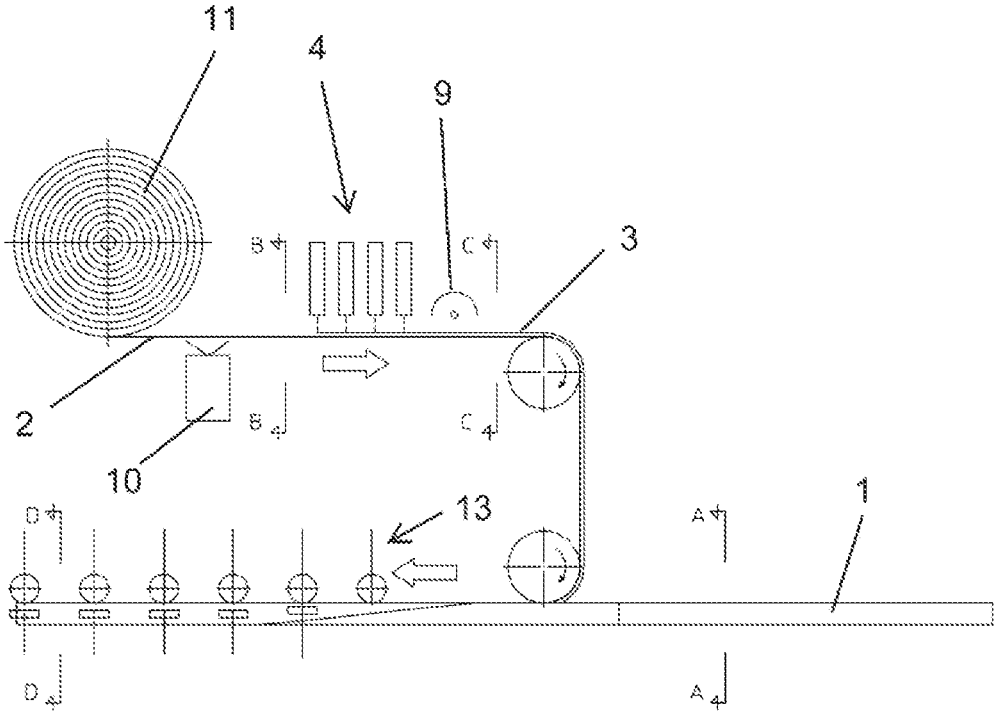
FIG. 1 schematically shows an exemplary embodiment of the method of the invention, by means of inkjet application on a decorative coating sheet to be incorporated on a substrate, of a glue as relief material and as a means for fixing the coating sheet to the substrate.
Figure 1A:
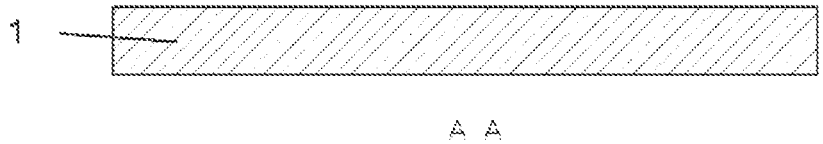
FIG. 1*a* is a cross-sectional view according to the A-A line shown in FIG. 1.
Figure 1B:
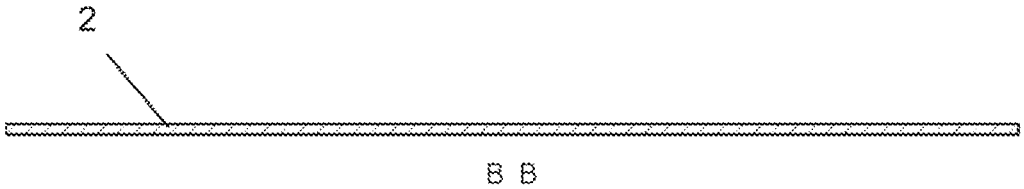
FIG. 1*b* is a cross-sectional view according to the B-B line shown in FIG. 1.
Figure 1C:
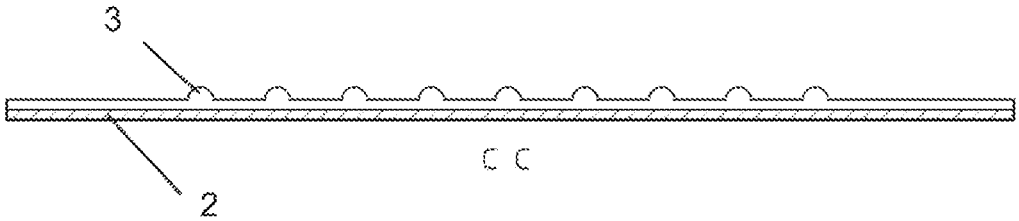
FIG. 1*c* is a cross-sectional view according to the C-C line shown in FIG. 1.
Figure 1D:
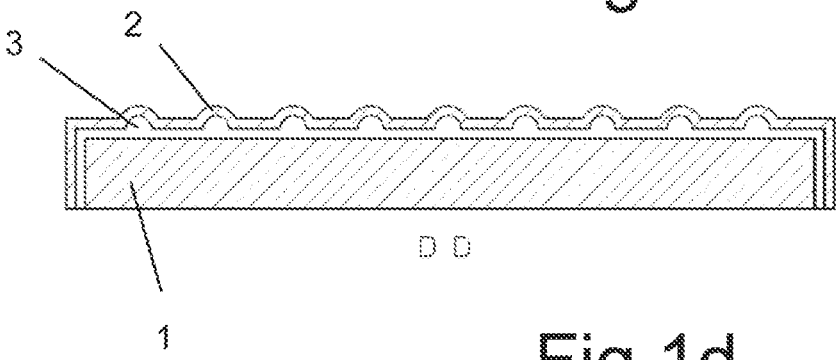
FIG. 1*d* is a cross-sectional view according to the D-D line shown in FIG. 1.
Figure 2:
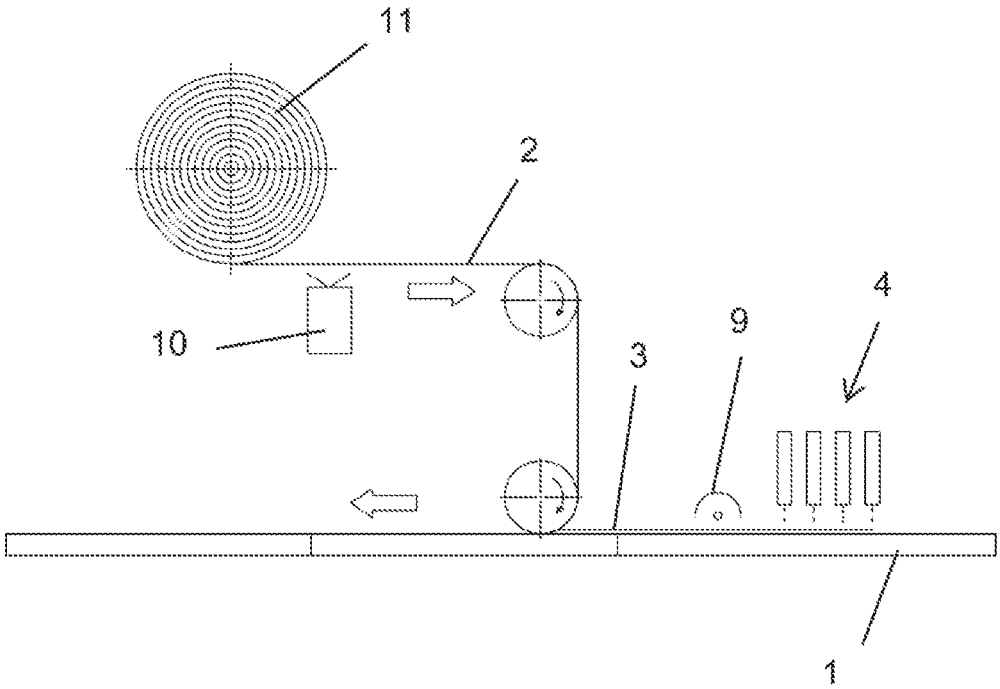
FIG. 2 schematically shows an exemplary embodiment of the method of the invention, by means of inkjet application on a substrate to be covered by a coating sheet, with a glue as relief material and as a means for fixing the coating sheet to the substrate.
Figure 3:
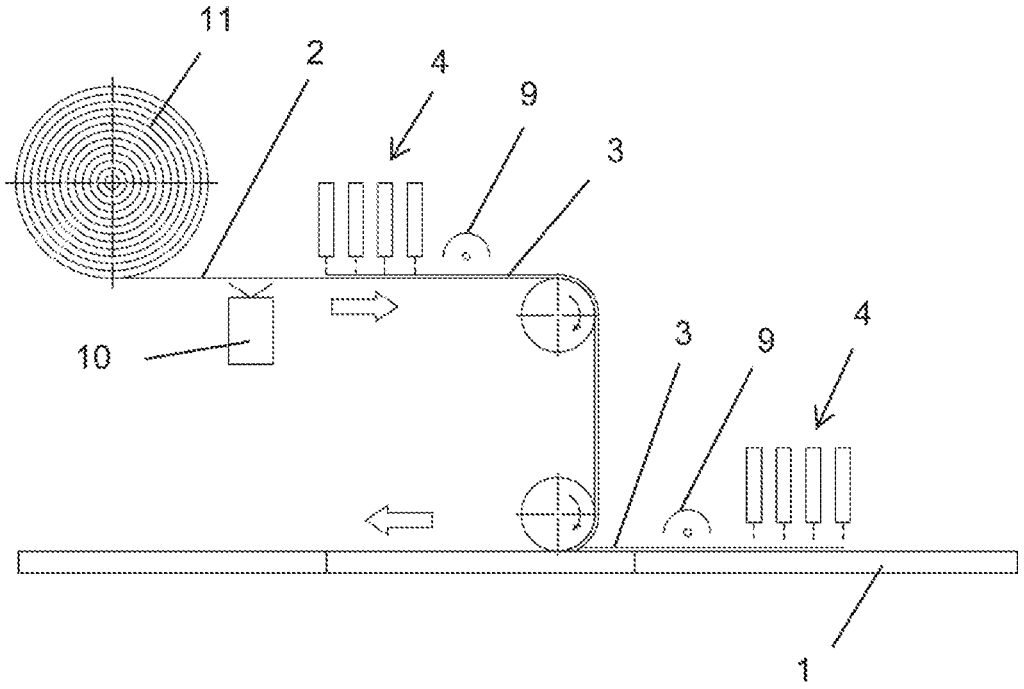
FIG. 3 schematically shows an exemplary embodiment of the method of the invention, by means of combined inkjet application on a substrate to be covered by a decorative coating sheet and on the coating sheet itself, of a glue as relief material and as a means for fixing the coating sheet to the substrate.
Figure 4:
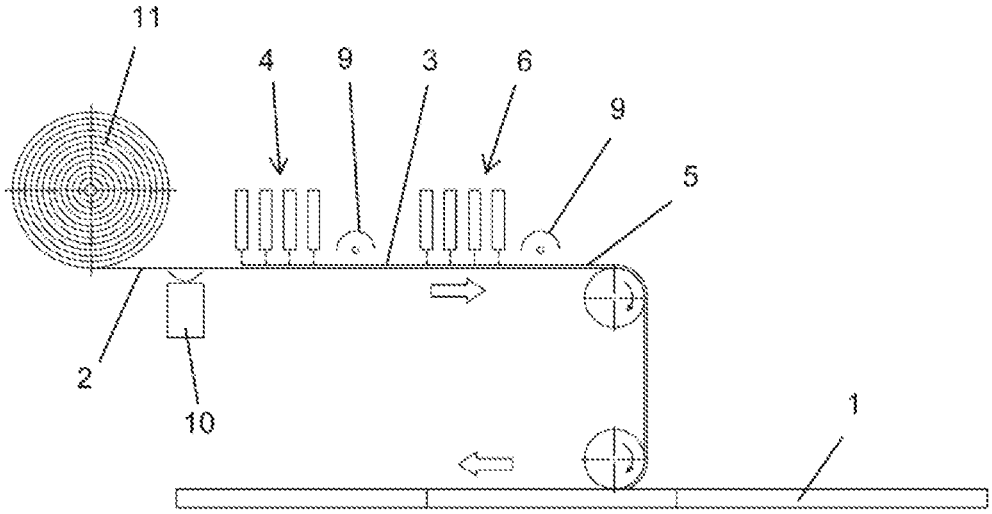
FIG. 4 schematically shows an exemplary embodiment of the method of the invention, by means of inkjet application of a relief material on a decorative coating sheet to be incorporated on a substrate and inkjet application on the coating sheet itself, of a glue as a means for fixing the coating sheet to the substrate.
Figure 5:
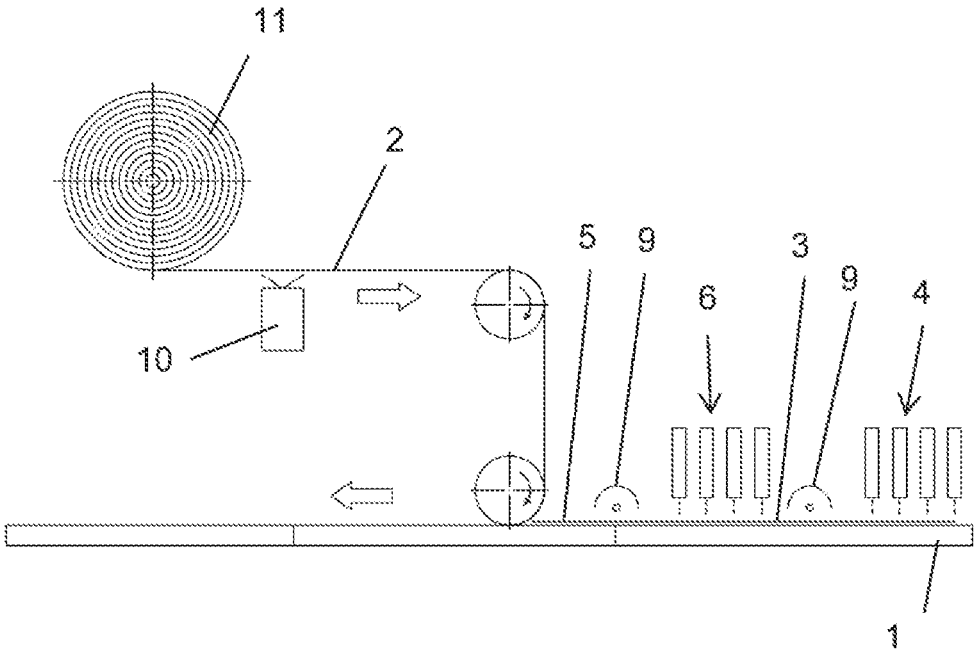
FIG. 5 schematically shows an exemplary embodiment of the method of the invention, by means of inkjet application, of a relief material on a substrate to be covered with a decorative coating sheet and inkjet application on the substrate itself, of a glue as relief material and as a means for fixing the coating sheet to the substrate.
Figure 6:
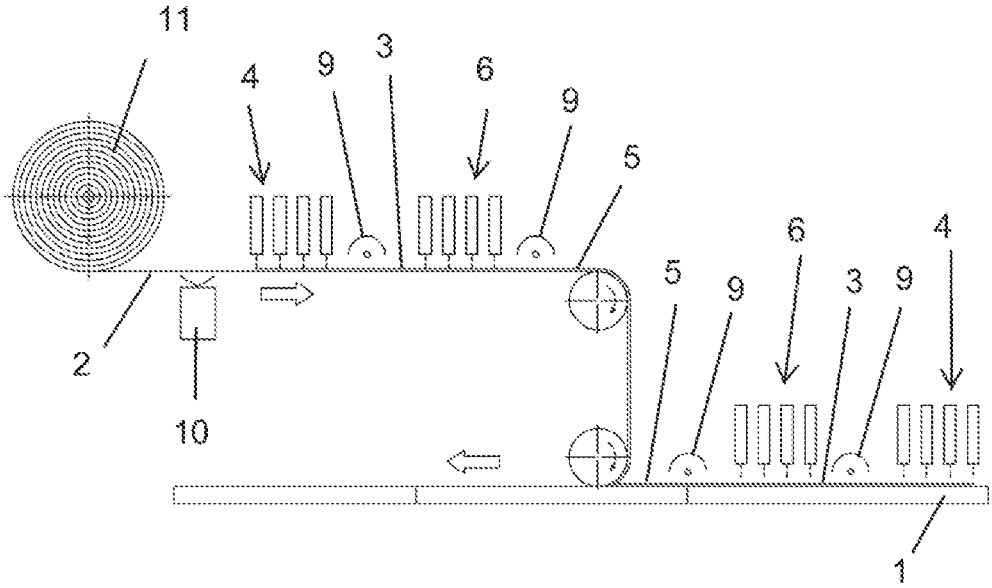
FIG. 6 schematically shows an exemplary embodiment of the method of the invention, by means of combined application on a substrate to be covered by a decorative coating sheet and on the decorative coating sheet itself, of relief material and a glue as a means for fixing the coating sheet to the substrate, both by inkjet application.

Therefore, the provision of relief material (3) is carried out by means of an inkjet (4) pass or application, which can be carried out on the coating sheet (2), such as in the examples of FIGS. 1, 4, 7 and 8, on the substrate (1), such as in the examples of FIGS. 2, 5, 9 and 10, or in a combined way, partially on the coating sheet (2) and partially on the substrate (1), as in the examples in FIGS. 3 and 6. The digital inkjet printing means comprise at least one printing head.

Figure 7:
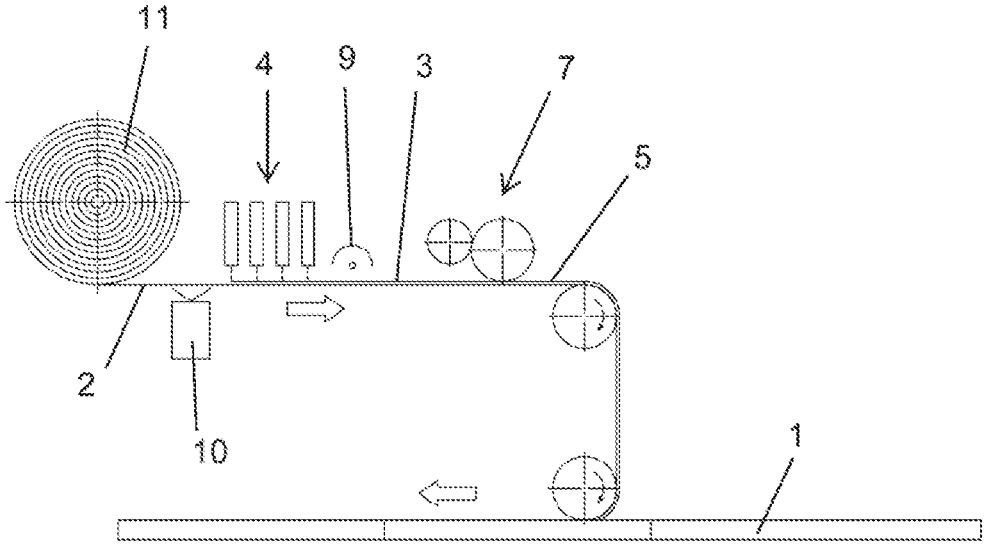
FIG. 7 schematically shows an exemplary embodiment of the method of the invention, by means of inkjet application of a relief material on a decorative coating sheet to be incorporated on a substrate and inkjet application on the coating sheet itself, by means of an applicator roller, with a glue as a means for fixing the coating sheet to the substrate.
Figure 8:
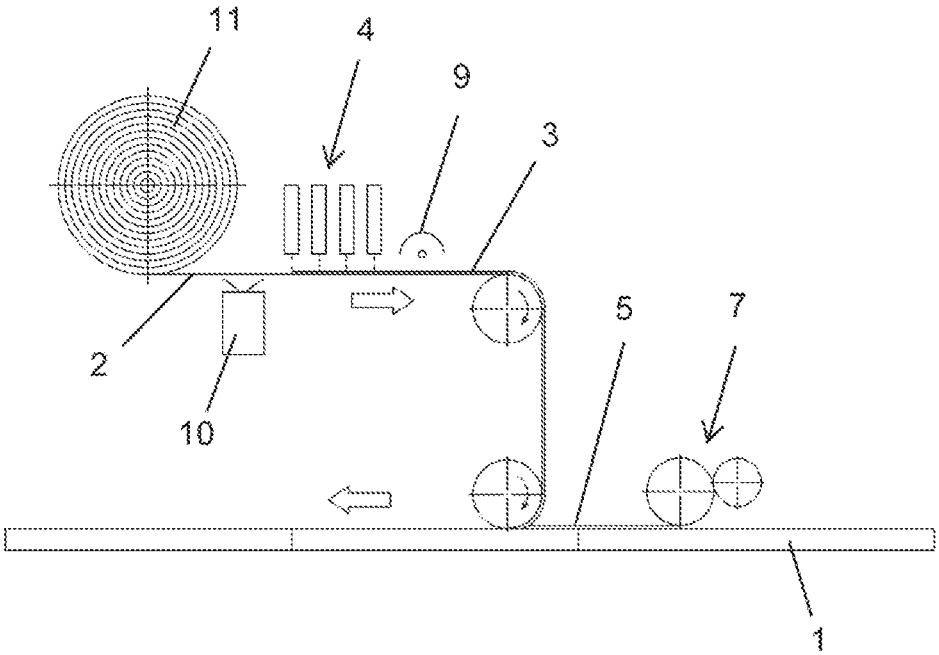
FIG. 8 schematically shows an exemplary embodiment of the method of the invention, by means of inkjet application of a relief material on a decorative coating sheet to be incorporated on a substrate and application on the substrate, by means of an applicator roller, with a glue for fixing the coating sheet to the substrate.
Figure 9:
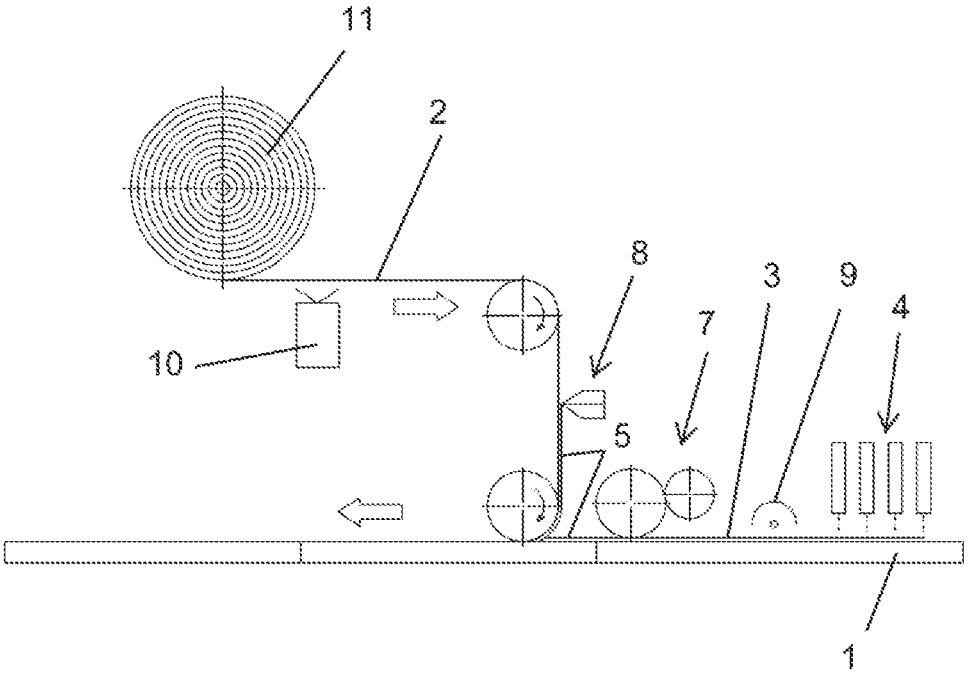
FIG. 9 schematically shows an exemplary embodiment of the method of the invention, by means of inkjet application, of a relief material on a substrate to be covered with a decorative coating sheet and application by means of a roller applicator on the substrate and by means of a lip applicator on the coating sheet, with a glue as a means for fixing the coating sheet to the substrate.

The provision of relief material (3) is combined with the provision of a glue (5) to fix the coating sheet (2) to the substrate (1), the glue (5) itself able to be used as relief material (3) and as a fixing means, as in the examples of FIGS. 1, 2 and 3, or the relief material (3) can be applied by means of an inkjet (4) pass or application and glue (5) can be independently applied by means of another inkjet (6) pass or application, such as in the examples of FIGS. 4, 5 and 6, or the independent application of glue (5) can be carried out by means of an applicator roller (7), such as in the examples of FIGS. 7 and 8, or in a combined way by means of an applicator roller (7) and by means of an applicator lip (8), such as in the example of FIG. 9; without the examples previously mentioned and represented in the drawings being limiting, since other techniques for applying glue (5) can likewise be used, such as spraying, etc.

In any case, the provision of relief material (3), either on the coating sheet (2) and/or on the substrate (1), is carried out by means of inkjet (4) application, providing the necessary amount of material based on the degree of relief (height or depth of the relief) to be obtained at each point, subsequently carrying out a certain degree of solidification or hardening, for example by means of UV radiation curing (9), although other techniques could also be used, such as electronic or electromagnetic radiation, heating, drying, evaporation, etc., to condition the relief material (3) to a suitable degree of cohesion, lastly incorporating the coating sheet (2) on the substrate (1), such that by means of the deformation of the coating sheet (2) on the relief material (3) applied, a textured surface of the substrate (1) is obtained, according to the desired relief. As shown in the figures, the means for incorporating the coating sheet can comprise pressure rollers to extend the sheet on the substrate pressing the same against the substrate.

As seen specifically in FIG. 1, according to the invention, a post-shaping of the coating sheet (2) against the substrate (1) is envisaged, in order to give shape to the sheet (2) on the substrate (1) along with the relief material (3) and the glue (5) placed between the sheet (2) and the substrate (1), the sheet (2) adapting to the geometry of the substrate (1). To do so, post-shaping means are incorporated, such as a pressure roller train (13) to press the sheet against the substrate.

Figure 11:
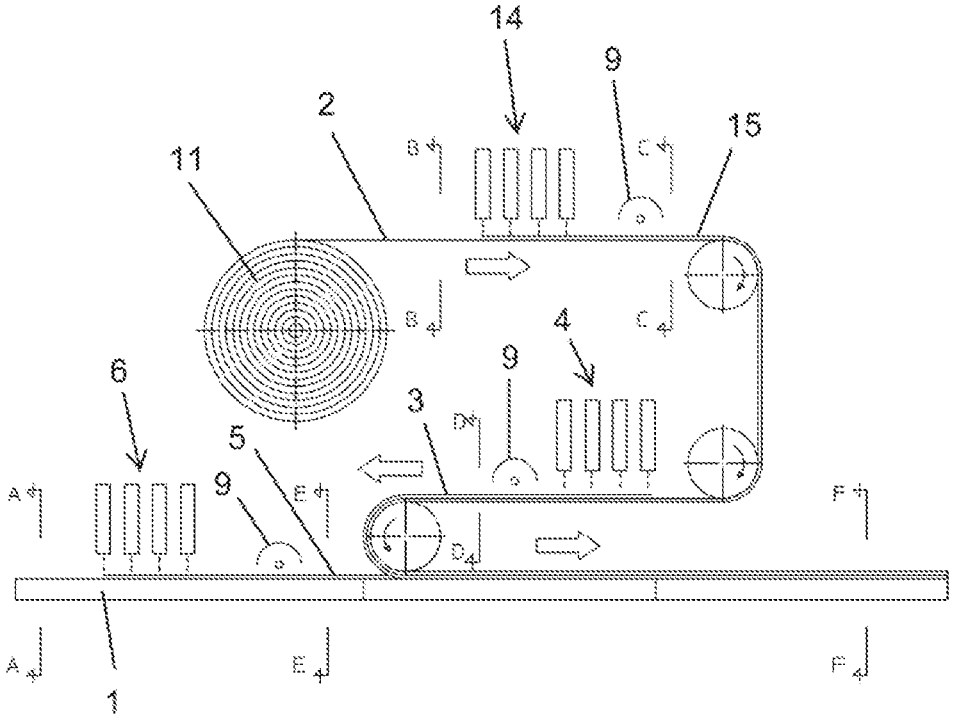
FIG. 11 schematically shows an exemplary embodiment wherein a decorative image is printed by inkjet on the coating sheet before providing the relief material and the glue, such that the decorative image and the relief obtained are synchronized.
Figure 11A:
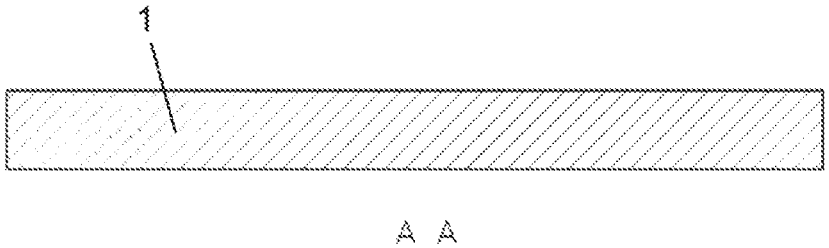
FIG. 11*a* shows a substrate.
Figure 11B:
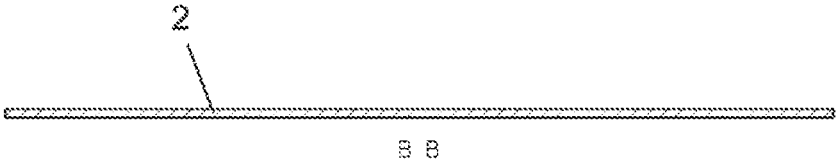
FIG. 11*b* shows coating sheet.
Figure 11C:
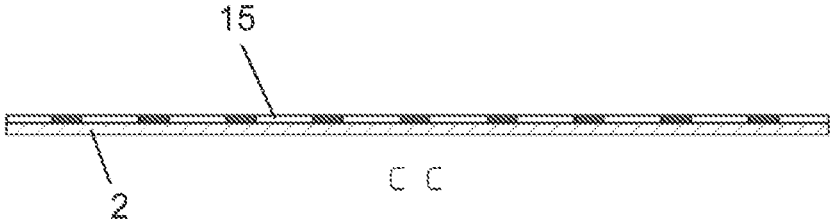
FIG. 11*c* shows the motifs on the coating sheet.
Figure 11D:
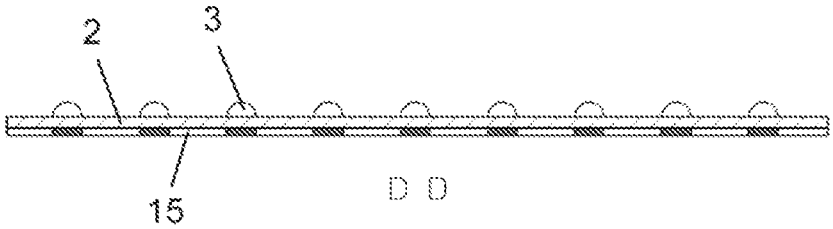
FIG. 11*d* shows coating sheets, relief material and the motifs.
Figure 11E:
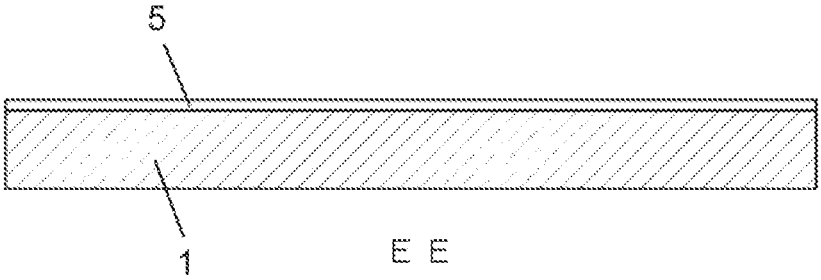
FIG. 11*e* shows the glue on the substrate.
Figure 11F:
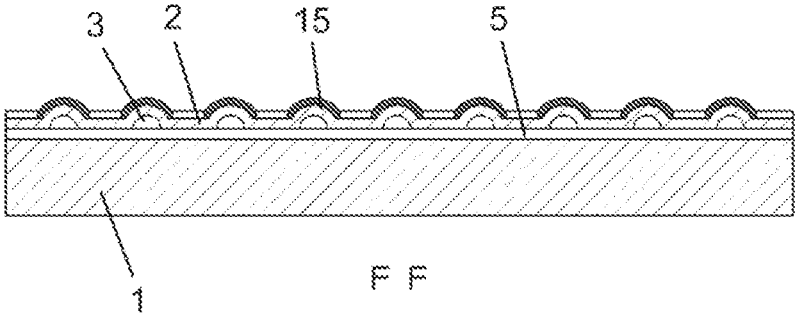
FIG. 11*f* shows the relief material, coating sheet, motifs, and glue on the substrate.

Furthermore, as seen specifically in FIG. 11, the provision of the relief material (3) is also envisaged in correspondence with motifs, in particular arranged in the coating sheet (2) or the substrate (1). For example, the motifs can consist of images (15) printed by means of inkjet (14) application, which can be applied previously (as shown in FIG. 11), subsequently or simultaneously to the application of the relief material (3), on the substrate (1) or on the coating sheet (2), the relief material (3) being provided by means of inkjet (4) application. The provision of relief material (3) is done, for example, in a controlled way by a scanner (10) based on printed images, thereby achieving a high quality textured surface imitating the appearance that is desired.

Figure 10:
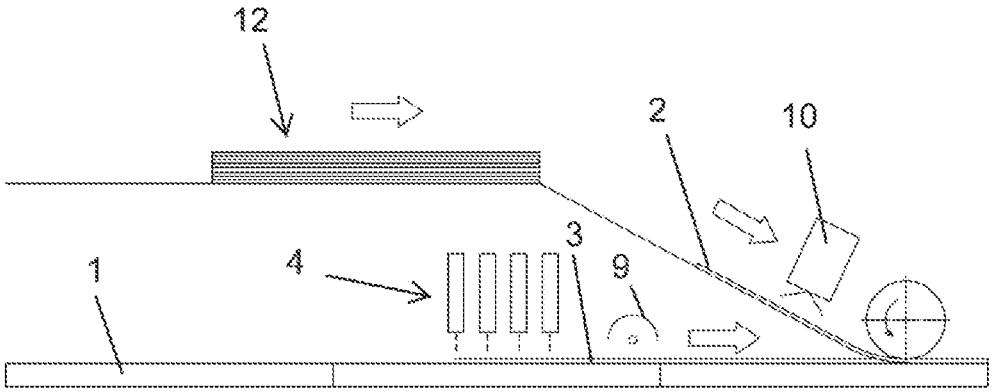
FIG. 10 schematically shows an exemplary embodiment of the method of the invention, by means of inkjet application on a substrate to be covered by a decorative sheet, of a glue as relief material and as a means for fixing the coating sheet to the substrate, the coating sheet being fed in independent sheets from a stack.

The coating sheet (2) that is incorporated to cover the substrate (1) over the relief material (3) can be supplied in a continuous way, for example from a feed spool (11), such as in the examples in FIGS. 1 to 9; but the coating sheet (2) can also be supplied in an individual or discontinuous way in the form of independent sheets supplied from, for example, a feed stack (12), such as in the example of FIG. 10, to place an independent coating sheet (2) in correspondence with each application substrate (1).

Additionally, means for preparing the surface of the substrate (1) are envisaged, such as means for cleaning or priming the surface of the substrate (1), before providing the relief material (3) or the glue (5).

The invention claimed is:

1. A method for producing reliefs on substrates comprising:

applying, by digital inkjet printing, drops of a relief material which is deposited on localized areas of a surface of a substrate to obtain a relief surface with a relief determined by the relief material deposited;

incorporating a coating sheet over the relief material deposited, which conforms to said relief surface, fixing the coated sheet by means of a glue, wherein the glue is applied with the relief material by means of the digital inkjet printing or wherein the glue is applied over the relief material by means of a different inkjet pass, before incorporating the coating sheet over the substrate.

2. The method for producing reliefs on substrates according to claim 1, wherein the relief material and the glue are applied on the coating sheet, to incorporate the coating sheet, with said application materials being deposited on the coating sheet, over the substrate.

3. The method for producing reliefs on substrates according to claim 1, wherein the relief material and the glue are applied on the substrate, the coating sheet being incorporated on the surface determined by said application materials deposited on the substrate.

4. The method for producing reliefs on substrates according to claim 1, wherein the relief material and the glue are partially applied on the substrate and partially on the coating sheet.

5. The method for producing reliefs on substrates according to claim 1, wherein the relief material and the glue are applied together by means of the same inkjet pass.

6. The method for producing reliefs on substrates according to claim 1, wherein the relief material and the glue are independently applied by means of respective inkjet passes.

7. The method for producing reliefs on substrates according to claim 1, wherein the relief material and the glue are independently applied, the relief material is applied by means of an inkjet pass and the glue by other application means, in particular by means of a roller or lip.

8. The method for producing reliefs on substrates according to claim 1, wherein the application of the relief material is synchronized with a motif arranged on the substrate or the coating sheet.

9. The method for producing reliefs on substrates according to claim 8, wherein the application of relief material is controlled by capturing said motif by means of scanning.

10. The method for producing reliefs on substrates according to claim 1, wherein after the application thereof, the relief material and/or the glue are at least partially solidified, in particular by curing or drying, before the coating sheet is incorporated.

11. The method for producing a relief on a substrate according to claim 1, wherein the coating sheet is supplied in a continuous way, in the form of a continuous sheet from a feed spool.

12. The method for producing reliefs on substrates according to claim 1, wherein the coating sheet is supplied individually in the form of an independent sheet from a feed stack.

13. A system for producing reliefs on substrates performing a method according to claim 1, comprising:

digital inkjet printing means to apply the relief material, transport means of the substrate, means for incorporating a coating sheet to incorporate the coating sheet over the substrate.

14. The system for producing reliefs on substrates according to claim 13, further comprising guide means for the coating sheet, glue application means, scanning means configured to capture a motif arranged on the substrate or the coating sheet and/or control means to carry out said method.

* * * * *